United States Patent [19]

Sturzenegger et al.

[11] Patent Number: 4,497,991

[45] Date of Patent: Feb. 5, 1985

[54] GAS-BLAST SWITCH

[75] Inventors: Christian Sturzenegger, Wettingen; Johann Blatter, Schönenwerd, both of Switzerland

[73] Assignee: Sprecher & Schuh AG, Aarau, Switzerland

[21] Appl. No.: 542,581

[22] Filed: Oct. 17, 1983

[30] Foreign Application Priority Data

Oct. 25, 1982 [CH] Switzerland ..... 6190/82

[51] Int. Cl.[3] ..... H01H 33/70

[52] U.S. Cl. ..... 200/148 A

[58] Field of Search ..... 200/148 A, 148 F

[56] References Cited

U.S. PATENT DOCUMENTS

| | | | |
|---|---|---|---|
| 4,322,591 | 3/1982 | Andersson et al. | 200/148 A |
| 4,351,993 | 9/1982 | Graf | 200/148 A |
| 4,379,958 | 4/1983 | Blatter et al. | 200/148 A |

FOREIGN PATENT DOCUMENTS

| | | | |
|---|---|---|---|
| 928445 | 5/1982 | U.S.S.R. | 200/148 A |

*Primary Examiner*—Robert S. Macon

*Attorney, Agent, or Firm*—Werner W. Kleeman

[57] ABSTRACT

A stationary contact element and a movable contact element are coupled to a drive unit. The movable contact element is surrounded by a co-movable blast nozzle which has an inlet flow communicating with a pump chamber surrounded by a pump cylinder. The pump cylinder is conjointly movable with the blast nozzle and the pump chamber contains an extinguishing gas which is pressurizable during a cut-off stroke. The pump chamber is bounded by the blast nozzle at one of its ends and by a spring-biased pump piston at its opposite end which is displaceable to a limited extent when the pressure in the pump chamber increases. A shock absorber is operatively associated with the spring-biased pump piston. To effectively attenuate the high-frequency pressure peaks generated by the switching arc and retroacting into the pump chamber the shock absorber and the spring biasing or supporting the pump piston are arranged such that the shock absorber only responds at the end of the stroke of the spring supporting the pump piston.

6 Claims, 5 Drawing Figures

GAS-BLAST SWITCH

BACKGROUND OF THE INVENTION

The present invention relates to a new and improved construction of gas-blast switch.

In its more specific aspects the invention relates to a new and improved gas-blast switch comprising a stationary contact element and a movable contact element operatively coupled to drive means and surrounded by a blast nozzle conjointly movable therewith. The blast nozzle has an inlet communicating with a pump chamber or space containing an extinguishing gas and pressurizable during a cut-off stroke of the gas-blast switch. The pump chamber or space is enclosed by a pump cylinder conjointly movable with the blast nozzle and is bounded at one of its ends by the blast nozzle and at its opposite or other end by a spring-supported pump piston which is displaceable from an initial or starting position when the pressure rises in the pump space. Operatively associated with the pump piston is a shock absorbing means.

In such type of gas-blast switches as known for example, from U.S. Pat. No. 2,922,010, granted Jan. 19, 1960, the extinguishing gas is displaced from the pump chamber or space through the blast nozzle during a cut-off stroke to blow the switching arc. On the other hand, the switching arc generates high frequency oscillations in the gas flow due to the enormous heating of the extinguishing gas. These oscillations also propagate back to the pump chamber or space at about the velocity of sound in the form of pressure peaks and pressure minima. To alleviate the effects of such pressure oscillations, which are superimposed upon on the ascending pressure of the extinguishing gas in the pump chamber or space during a cut-off stroke, on the mechanical components of the switch which delimit the pump space the pump piston is resiliently supported and shock absorbing means are associated therewith.

In the aforementioned prior art construction of gas-blast switch, however, the pump piston is directly supported at the spring operatively associated therewith as well as directly coupled to the shock absorbing means. Additionally, the shock absorbing means have a decidedly strongly degressive characteristic, i.e., the shock absorbing means are very "rigid" or "hard" during the initial pressure-caused yielding movements of the pump piston. Only when the pump piston is near the end of the cut-off stroke, i.e., when the volume of the pump chamber or space practically has decreased to zero, and such pump piston is positively further displaced by the pump cylinder against the action of the spring, i.e., when the pump piston already has travelled through a certain distance while yielding, does the hydraulically designed shock absorbing means of the known gas-blast switch assumes a "soft" characteristic. Such design, however, does not contribute to alleviating the effects of the aforementioned pressure oscillations, rather is designed with the intent of decreasing the pumping stroke of the pump cylinder relative to the pump piston in comparison to the total switching stroke. In this known construction of gas-blast switch all of the components bounding the pump chamber or space, notwithstanding the provision of the spring support for the pump piston, have to be dimensioned in consideration of the magnitude of the highest possible pressure peaks occurring in the pump chamber or space, and also the drive means for the gas-blast switch have to be correspondingly dimensioned.

SUMMARY OF THE INVENTION

Therefore, with the foregoing in mind it is a primary object of the present invention to provide a new and improved construction of gas-blast switch in which, above all, the dangerous pressure peaks occurring in the pump chamber or space can be absorbed to a large extent.

Now in order to implement this and still further objects of the invention, which will become more readily apparent as the description proceeds, the gas-blast switch of the present development is manifested by the feature that, the shock absorbing means and the spring supporting or biasing the pump piston are arranged in succession or series such that the shock absorbing means respond at the end of the stroke of the spring supporting the pump piston.

In the gas-blast switch according to the invention, the pump piston at first is thus substantially free to yield against only the action of the spring. Only when the pressure peaks are so high that the spring is at the region of the end of its spring stroke, will the shock absorbing means begin to respond and become effective.

Preferably purely mechanical so-to-speak friction-based or frictionally-operative shock absorbing means are used in the inventive gas-blast switch, so that no hydraulic pressure fluid is required and no risk of a leak exists at all.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures there have been generally used the same reference characters to denote the same or analogous components, and wherein.

DETAILED DESCRIPTION OF THE PREFERRED EMBODIMENTS

Figure 1:
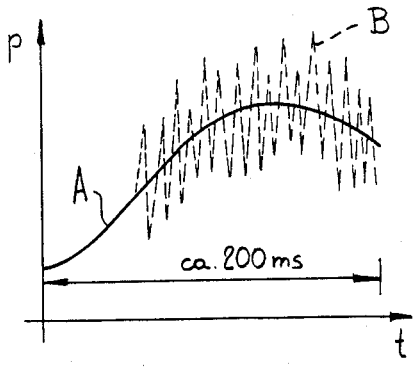
FIG. 1 is a simplified representation of the basically desired variation of pressure in the pump chamber or space of a gas-blast switch as a function of time in comparison to the actually existing pressure course or pattern as a function of time.

Describing now the drawings, it is to be understood that only enough of the construction of the gas-blast switch has been shown as needed for those skilled in the art to readily understand the underlying principles and concepts of the present development, while simplifying the showing of the drawings. Turning attention now specifically to FIG. 1, there has been illustrated by a continuous curve A the pattern as a function of time pressure in the pump chamber or space which is strived for during a cut-off stroke which lasts for about 200 milliseconds. The broken or phantom line curve B, contrary thereto, shows the actual pressure pattern as a function of time in the pump chamber or space of a conventional gas-blast switch. It will be seen that on igniting the switching arc, i.e., shortly after the start of the cut-off stroke, high-frequency pressure oscillations are superimposed on the desired pressure pattern A which, as will be shown later, can be absorbed to a large extent in the inventive gas-blast switch prior to acting upon essential mechanical elements of the gas-blast switch. Accordingly, such mechanical elements also can be designed to be lighter without loss in their robustness and functionality.

In the following, reference is made to FIGS. 2 and 3.

Figure 2:
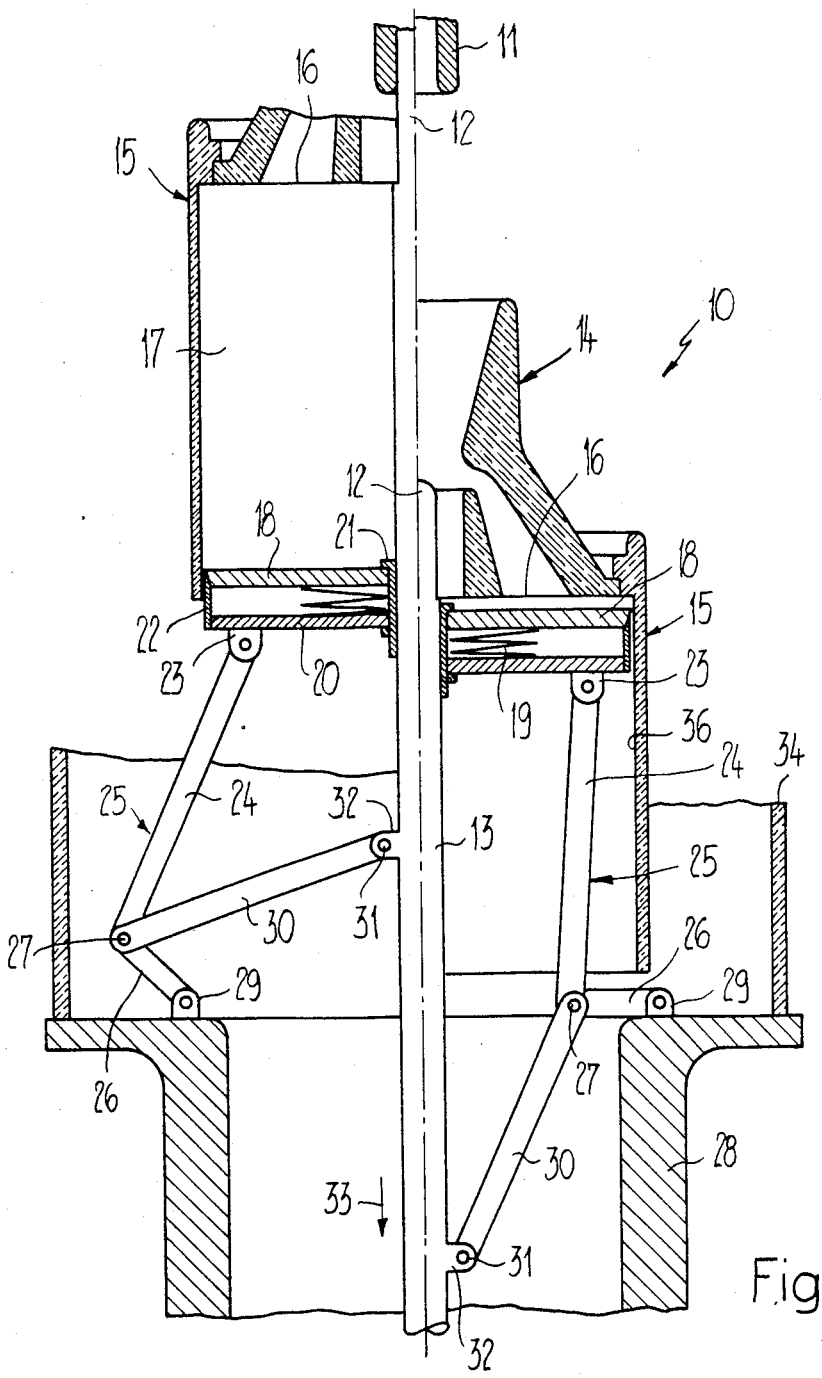
FIG. 2 is an enlarged schematic axial section through a gas-blast switch according to the invention, the left-hand half of the drawing showing the gas-blast switch in the closed position and the right-hand half of the drawing showing the gas-blast switch in the opened position.

The gas-blast switch 10 as illustrated in FIG. 2 corresponds, as will be shown later, to a large extent to the gas-blast switch disclosed in U.S. Pat. No. 4,329,553, granted May 11, 1982, which is the cognate patent to Swiss Pat. No. 630,744, with the exception of the structure of the pump piston. Therefore, the disclosure of such patents is incorporated herein by reference.

There will be recognized a tube-shaped or tubular stationary contact element 11 which cooperates with a movable contact element 12 which, in turn, forms the end of a driving or switching rod 13 constituting a drive. The movable contact element 12 is surrounded by a blast nozzle 14 secured thereto which, in turn, is mounted at one end of a pump cylinder 15. The inlet 16 of the blast nozzle 14 flow communicates with a pump chamber or chamber or space 17 enclosed by the pump cylinder 15. At its other end the pump space 17 is bounded by a pump piston 18 which is displaceable relative to the pump cylinder 15 and supported by a set of plate springs 19 or equivalent structure at a support plate 20. The pump piston 18 is also displaceably mounted on a sliding or guide sleeve 21 which centrally piercingly traverses the pump piston 18 and, in turn, is displaceable along the driving or switching rod 13. The sliding sleeve 21 also piercingly extends through the support plate 20 which, in turn, may be stationarily seated on the sliding sleeve 21 or may be displaceable thereon.

An expandable sleeve or sleeve member 22 is mounted on the side of the outer circumference of the support plate 20 and extends towards the pump piston 18; the expandable sleeve 22 will be discussed in greater detail with reference to FIGS. 3 and 4.

On the side of the support plate 20 which is remote or facing away from the pump piston 18 there is mounted in a bearing eyelet 23 one element 24 of a toggle or knee-action structure, here specifically a toggle lever, generally designated by reference character 25, the other element 26 of which is linked to a stationary location or element as, for example, a bearing eyelet 29 formed at a housing support 28. To a toggle joint 27 which is formed by the interconnection of the toggle elements 24 and 26 of the toggle lever 25 there is linked one end of a connecting rod or rocker arm 30, the other end of which is linked or hinged at 31 to a bearing eyelet 32 formed at the driving rod 13. The significance and the purpose of this lever transmission system comprising the toggle lever 25 and the connecting rod 30 is described in detail in the U.S. Pat. No. 4,329,553 and the cognate Swiss Pat. No. 630,744 already mentioned before. Toggle lever drive systems for gas-blast switches are also disclosed in U.S. Pat. No. 4,351,993, granted Sept. 28, 1982, to which reference may be had. Essentially, the significance and purpose of such a lever transmission system is to first move the support plate 20, and thus, also the pump piston 18 in the same direction as the driving rod 13 at the start of a cut-off stroke which is performed in the direction of the arrow 33, so that the compression of the extinguishing gas in the pump chamber or space 17 will only begin when the driving rod 13 and in conjunction therewith also the blast nozzle 14 including the pump cylinder 15 have already been accelerated.

The gas-blast switch 10 is sealingly enclosed towards the exterior by a here only schematically illustrated switch housing 34 made of any suitable electrically insulating material.

Figure 3:
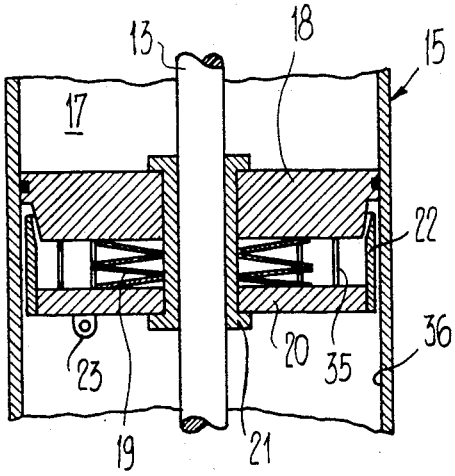

Viewing now the arrangement of FIG. 3 it will be recognized that the circumference of the pump piston 18 tapers towards the support plate 20 on the side remote from the pump chamber or space 17. In a relaxed state of the set of springs 19, the pump piston 18 extends with some play into the expandable sleeve 22. The expandable sleeve 22 comprises slots 35 which are distributively arranged about the circumference thereof. Upon the occurrence of pressure peaks in the pump chamber or space 17 the pump piston 18 at first can only yield against the action of the set of springs 19. In the case of specifically high pressure peaks the pump piston 18, however, will penetrate into the expandable sleeve 22 to such an extent that the same is expanded and thus frictionally engages the interior wall 36 of the pump cylinder 15. The coaction of the interior or inner wall 36 with the expandable sleeve 22 corresponds to the mode of operation of a frictional shock absorber.

Figure 4:
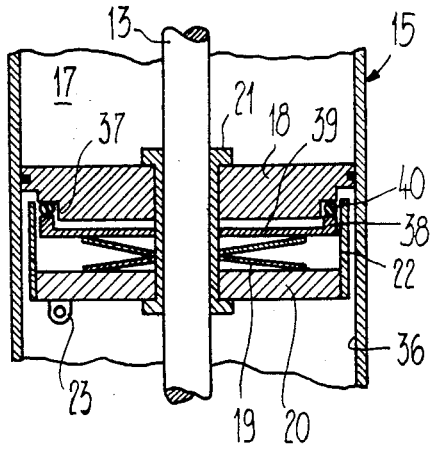
FIGS. 3 to 5 show axial sections of the gas-blast switch illustrated in FIG. 2 portraying more details with respect to the arrangement of the pump piston and depicting further possible modifications thereof.

The design shown in FIG. 4 functions in a similar manner. In this case a shoulder 37 is formed on the side of the pump piston 18 which is remote or facing away from the pump space 17. Intermediate the shoulder 37 and an enlarged circumferential margin or edge 38 of an intermediate plate 39 there is arranged an elastomer element 40. The set of springs 19, which in this case comprises two plate springs, is arranged between the intermediate plate 39 and the support plate 20. In the case of considerable pressure pulses the pump piston 18 yields and compress the set of springs 19 up to the end of the spring stroke by means of the elastomer element 40 and the intermediate plate 39. Thereafter the elastomer element 40 will be compressed in axial direction which results in an expansion thereof in radial direction. This radial expansion is transferred to the expandable sleeve 22 which, then, just as was the case for the arrangement of FIG. 3, frictionally engages the interior wall 36 of the pump cylinder 15. Instead of using the expandable sleeve 22 a non-slotted tube section may be provided. In such case the elastomer element 40, when expanded in radial direction, engages with the interior or inner wall of the tube section.

Figure 5:
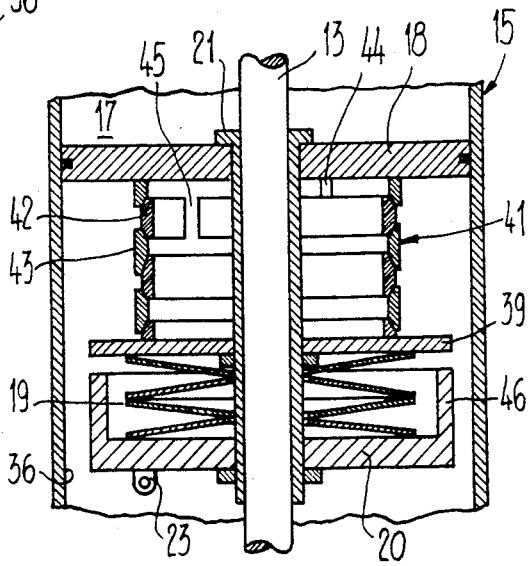

In the embodiment illustrated in FIG. 5 the frictional engagement with the interior or inner wall 36 of the pump cylinder 15 is dispensed with. The pump piston 18, in this case, is supported upon a set of annular springs 41 comprising, for example, three inner rings 42 and three outer rings 43. While all outer rings 43 have a longitudinal slot 44, only one of the inner rings 42 has a longitudinal slot 45. It will be understood that alternatively any other suitable set of annular springs can be selected like, for example, a set comprising solid outer rings and slotted inner rings. The set of annular springs 41 is supported at the intermediate plate 39. The support plate 20 comprises an upwardly projecting circumferential margin or rim 46 and the set of plate springs 19 which, in this case, comprises for instance four plate springs is arranged between the intermediate plate 39 and the circumferential margin or rim 46.

When high pressure peaks occur in the pump chamber or space 17 the set of springs 19, which can be adjusted more softly than the set of annular springs 41 will at first yield until the intermediate plate 39 engages the upper edge of the circumferential margin or rim 46. Thereafter the set of annular springs 41 is axially compressed or bowed; the set of annular springs 41 any way possesses pronounced dampening characteristic due to the friction prevailing between the inner rings 42 and the outer rings 43. Since one of the inner rings 43 in the set of annular springs 41 has an axial slot 45, the spring rate of the entire set of annular springs 41 is comparatively small at the beginning of the compression or bowing operation, although greater than that of the set of plate springs 19. The spring rate of the set of annular springs 41 abruptly increases when the axial slot 45 of the inner ring 42 is closed due to the compression or bowing operation. In this case the pump piston 18 is thus resiliently supported by two series arranged spring elements, namely the set of plate springs 19 and the set of annular springs 41, wherein the set of plate springs 19 is practically undamped while the set of annular springs 41, in addition to the distinct and progressively acting spring characteristic, simultaneously displays a strong shock absorbing action.

While in the gas-blast switch 10 as described hereinbefore the support plate 20 is coupled to the driving rod 13 via the lever transmission system, and thus is also movable, it will be understood that the heretofore described constructions are also applicable to gas-blast switches of the type in which the support plate 20 is stationarily supported. However, in the constructions of gas-blast switch 10 as described hereinbefore the above-discussed design is of specific advantage because the stresses originating from the pressure peaks are to a large extent held away from the links or levers of the lever transmission system and from the joints or hinges thereof, so that the linkage arrangement may be dimensioned to be lighter and also with greater clearance in the joints or hinges.

While there are shown and described present preferred embodiments of the invention, it is to be distinctly understood that the invention is not limited thereto, but may be otherwise variously embodied and practiced within the scope of the following claims. Accordingly,

What we claim is:

1. A gas-blast switch comprising:

a stationary contact element;

drive means for carrying out at least a cut-off stroke;

a movable contact element coupled to said drive means;

a blast nozzle having an inlet;

said blast nozzle surrounding said movable contact element and being conjointly movable therewith;

a pump cylinder enclosing a pump chamber containing an extinguishing gas;

said inlet communicating with said pump chamber;

said pump cylinder being conjointly movable with said blast nozzle to pressurize said pump chamber during said cut-off stroke;

said pump cylinder having opposite ends;

said pump cylinder being bounded by said blast nozzle at one of its ends;

a spring-biased pump piston bounding said pump cylinder at said other end thereof and being displaceable from an initial position by ascending pressure in said pump chamber;

at least one spring acting upon said pump piston;

shock absorbing means operatively associated with said pump piston; and said spring acting upon said pump piston and said shock absorbing means being successively arranged such that said shock absorbing means becomes effective at the end of a stroke performed by said spring.

2. The gas-blast switch as defined in claim 1, wherein:

said shock absorbing means comprises at least one set of annular springs.

3. The gas-blast switch as defined in claim 1, wherein:

said pump cylinder defines an interior wall;

said shock absorbing means comprises a resilient expandable sleeve coaxially arranged in said pump cylinder;

said expandable sleeve forms a clearance with said interior wall in an unloaded state of said spring which acts upon said pump piston; and means for frictionally pressing said expandable sleeve against said interior wall at said end of said stroke of said spring acting upon said pump piston.

4. The gas-blast switch as defined in claim 3, wherein:

said expandable sleeve defines an inner wall;

said means for frictionally pressing said expandable sleeve against said interior wall comprises at least one elastomer element arranged adjacent said inner wall of said expandable sleeve; and said elastomer element is axially compressible at said end of said stroke of said spring acting upon said pump piston in order to be radially expanded so as to expand said expandable sleeve.

5. The gas-blast switch as defined in claim 2, further including:

a support plate;

an intermediate plate having sides;

said pump piston having a side remote from said pump chamber;

said set of annular springs being arranged between one opposite side of said intermediate plate and said side of said pump piston; and a set of plate springs arranged between the other opposite side of said intermediate plate and said support plate.

6. The gas-blast switch as defined in claim 3, further including:

a support plate;

said expandable sleeve defining one end and being circumferentially mounted to said support plate at said one end;

a set of plate springs arranged intermediate said support plate and said pump piston;

said set of plate springs having a greater axial dimension in a relaxed state thereof than said expandable sleeve; and said pump piston having a portion facing away from said pump chamber and which is conically structured in order to penetrate into said expandable sleeve and expand the same at the end of a predetermined stroke of said set of plate springs.

* * * * *